US010478891B2

(12) United States Patent
Sen et al.

(10) Patent No.: US 10,478,891 B2
(45) Date of Patent: Nov. 19, 2019

(54) SYSTEM FOR IMPREGNATION OF CASTINGS

(71) Applicants: Saibal Sen, Pune (IN); Probal Sen, Pune (IN)

(72) Inventors: Saibal Sen, Pune (IN); Probal Sen, Pune (IN)

( * ) Notice: Subject to any disclaimer, the term of this patent is extended or adjusted under 35 U.S.C. 154(b) by 0 days.

(21) Appl. No.: 16/072,492

(22) PCT Filed: Jan. 10, 2017

(86) PCT No.: PCT/IN2017/000007
§ 371 (c)(1),
(2) Date: Jul. 24, 2018

(87) PCT Pub. No.: WO2017/130211
PCT Pub. Date: Aug. 3, 2017

(65) Prior Publication Data

US 2019/0039129 A1 Feb. 7, 2019

(30) Foreign Application Priority Data

Jan. 28, 2016 (IN) ..... 3661/MUM/2015

(51) Int. Cl.
*B22D 31/00* (2006.01)
*B05C 13/02* (2006.01)

(52) U.S. Cl.
CPC ..... *B22D 31/005* (2013.01); *B05C 13/02* (2013.01)

(58) Field of Classification Search
USPC .... 118/66, 64, 423, 50, 50.1, 427, 428, 429, 118/500; 422/242; 427/294, 243, 240,
(Continued)

(56) References Cited

U.S. PATENT DOCUMENTS 4,196,231 A * 4/1980 Hubers ..... B04B 3/00 118/423
4,399,828 A * 8/1983 Kontos ..... C25D 17/28 118/418

(Continued)

FOREIGN PATENT DOCUMENTS

WO 2004/043632 A2 5/2004

OTHER PUBLICATIONS

International Search Report and Written Opinion dated May 17, 2017 in International Application No. PCT/IN2017/000007, filed Jan. 10, 2017.

*Primary Examiner* — Yewebdar T Tadesse
(74) *Attorney, Agent, or Firm* — Wiley Rein LLP

(57) ABSTRACT

A system (100) for impregnation of castings is disclosed. The system (100) comprises a basket (10) and a gantry (50). The basket (10) includes a plurality of bins (12) and a stub (14) configured thereon. The plurality of bins (12) is adapted for holding the castings thereon and is lined with a partition sheet having a plurality of perforations (12A) and plurality of slots (12B) configured thereon. The gantry (50) includes grippers (16) configured thereon. The system (100) is designed to allow partial or full loading of the basket (10) with different castings held therein in a balanced manner to be impregnated without being damaged. The system (100) prevents excess sealant consumption from basket surfaces as well as prevents sticking of the sealant on gripper's pins (15) thereby preventing frequent blockage/jamming issues.

9 Claims, 4 Drawing Sheets

(58) Field of Classification Search
USPC ..... 427/379, 248
See application file for complete search history.

(56) References Cited

U.S. PATENT DOCUMENTS 4,479,986 A * 10/1984 Juday ..... B22D 31/005
118/50
4,520,045 A 5/1985 Kutsuna et al.
4,722,295 A * 2/1988 Young ..... B05C 3/08
118/416
6,913,650 B2 * 7/2005 Gilmore ..... B05C 3/02
118/423

* cited by examiner

SYSTEM FOR IMPREGNATION OF CASTINGS

RELATED APPLICATIONS

This Application is a § 371 entry of International Application PCT/IN2017/000007, filed Jan. 10, 2017, which claims priority benefit of Application No. 3661/MUM/2015, filed Jan. 28, 2016, each of which is incorporated by reference in its entirety for all purposes.

FIELD OF THE INVENTION

The present invention relates to impregnation system and more particularly to the system for impregnation of castings.

BACKGROUND OF THE INVENTION

Generally, castings leak on pressurization due to defects/porosities. The porosities in the castings are caused by internal shrinkages or gas cavity, oxide films and inclusions etc.

To prevent leaks in the casting during pressurization, vacuum impregnation of the casting is carried out. Vacuum impregnation is the process of sealing the porosity in castings. Specifically, an impregnation material, or the impregnant, also called sealant or resin is introduced into the porosity within the wall thickness of the casting using vacuum. The liquid sealant that penetrates into the porosities is subsequently cured by heating at elevated temperature.

A fully automated system having a basket loaded with castings is generally used to impregnate castings. During the process of impregnation using the existing basket, the half-filled baskets with castings cannot be used without the basket being balanced and the components being fixtured tightly. Further, the castings in the baskets get damaged due to collision to each other during the process of impregnation if they are not restricted from movement within the basket. Further, the baskets must be suitable for handling multiple castings of different shapes and sizes therein to ensure that the components fit correctly in the basket as well as also can be fixed in some way to prevent them from colliding against each other. Moreover the baskets also need to be universal for the fully automated system so that there is optimum space utilization within the basket in a balanced condition when loaded, fully or partially.

Accordingly, there exists a need to provide a system for impregnation of castings that overcomes the above mentioned drawbacks of the prior art.

OBJECTS OF THE INVENTION

An object of the present invention is to impregnate casting without any damage to the castings.

Another object of the present invention is to hold casting in position during the rotation cycles of the impregnation process.

Still another object of the present invention is to load fully or partially the baskets with different castings in a balanced manner.

Yet another object of the present invention is to prevent any excess sealant consumption from basket surfaces and to optimize the sealant consumption and wastages.

Further object of the present invention is to provide a design such that there is no blockage or jamming of pins or pivoted moving parts wherever used in the basket or the machine due to sealant sticking and polymerising.

SUMMARY OF THE INVENTION

Accordingly, the present invention provides a system for impregnation of castings. The system comprises a basket and a gantry. The basket is adapted for being loaded with multiple castings and removably placed in a vacuum chamber for impregnation of the castings with a sealant. The multiple castings are of different sizes and shapes thereon. The sealant is capable of flowing to and from a storage chamber into the vacuum chamber through an operation of a valve connected there between. Both the vacuum chamber and the storage chamber include a plurality of sensors configured thereon to control the operation of the valve and the resulting flow of sealant such that the gantry never makes contact with the sealant in the vacuum chamber.

The basket is made up of a material selected from any one of stainless steel, mild steel and a steel material duly chrome plated or surface protected to avoid rusting and is surface finished or polished to prevent the sealant from retaining thereon thereby preventing excess consumption of the sealant. The basket includes a plurality of bins and a stub configured therein.

The plurality of bins is fitted in the basket to hold the castings thereon without causing the castings to come in contact with each other during impregnation of castings. Each bin of the plurality of bins includes a sliding mechanism configured on an upper side thereof. The plurality of bins is slidably fitted inside the basket through the sliding mechanism. The plurality of bins is lined with a partition sheet. The partition sheet includes a plurality of perforations and a plurality of slots configured thereon. The plurality of perforations provides water jet washing effect during wash and hot cure cycles of the castings. The plurality of slots provides provide complete access to the water for all holes in the castings for better washablity. The stub is configured on both ends of the basket for orientation thereof. The stubs include a hard chrome plating finish of 100 microns.

The gantry is capable of lifting the basket for placement thereof into the vacuum chamber before the impregnation of the castings as well as removal thereof from the vacuum chamber after the return of the sealant to the storage chamber to place the loaded basket in a hotcure chamber after the impregnation of the castings. The gantry includes a gripper configured on both sides thereof for gripping and lifting the basket through the stubs. The grippers are mild steel or stainless steel plated with a hard chrome plating finish of 100 microns. The grippers include pins configured thereon to prevent sticking of the sealant therein thereby preventing jamming issues.

DETAILED DESCRIPTION OF THE INVENTION

The foregoing objects of the invention are accomplished, and the problems and shortcomings associated with the prior art techniques and approaches are overcome by the present invention as described below in the preferred embodiment.

The present invention provides a system for impregnation of castings. The system is designed to allow partial or full loading of baskets with different castings in a balanced manner. The system allows holding the castings in position during the impregnation process to impregnate the casting without causing any damage thereto, without causing blockage or jamming of pins wherever used in the basket while at the same time preventing any excess sealant consumption from basket surfaces.

The present invention is illustrated with reference to the accompanying drawings, throughout which reference numbers indicate corresponding parts in the various figures.

Figure 1:
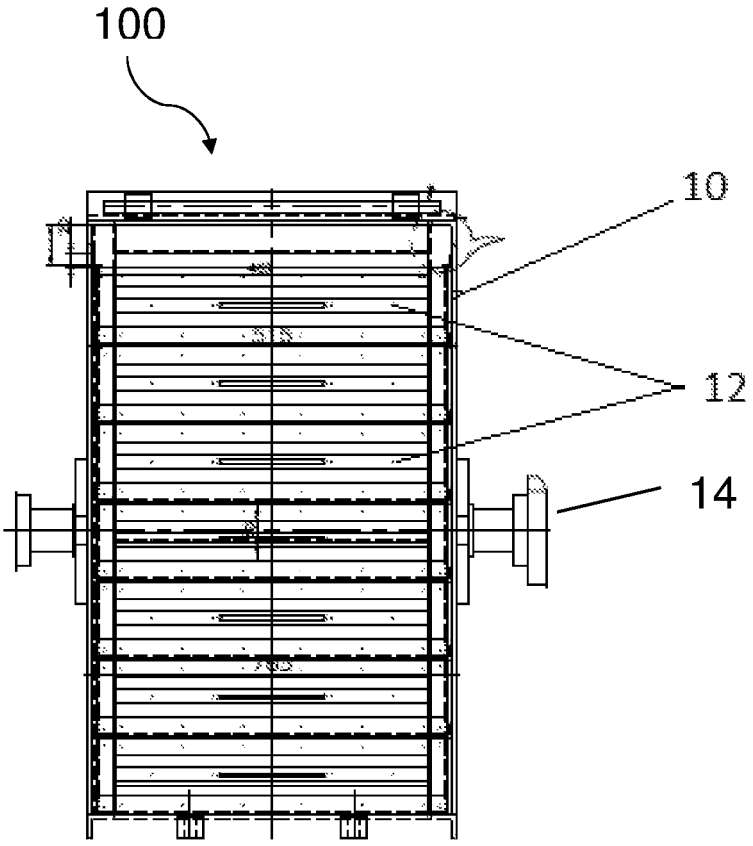
FIG. 1 shows a basket and a plurality of bins of a system for impregnation of castings, in accordance with the present invention.
Figure 2:
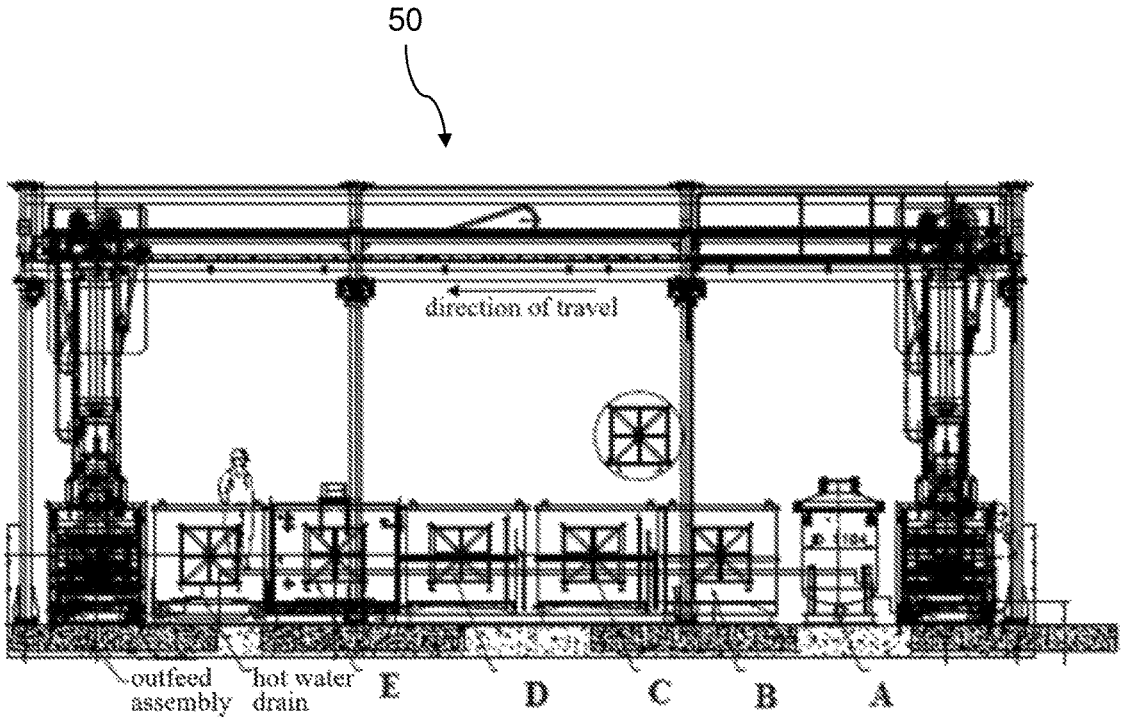
FIG. 2 shows a gantry with various chambers for impregnation of castings, in accordance with the present invention.
Figure 3:
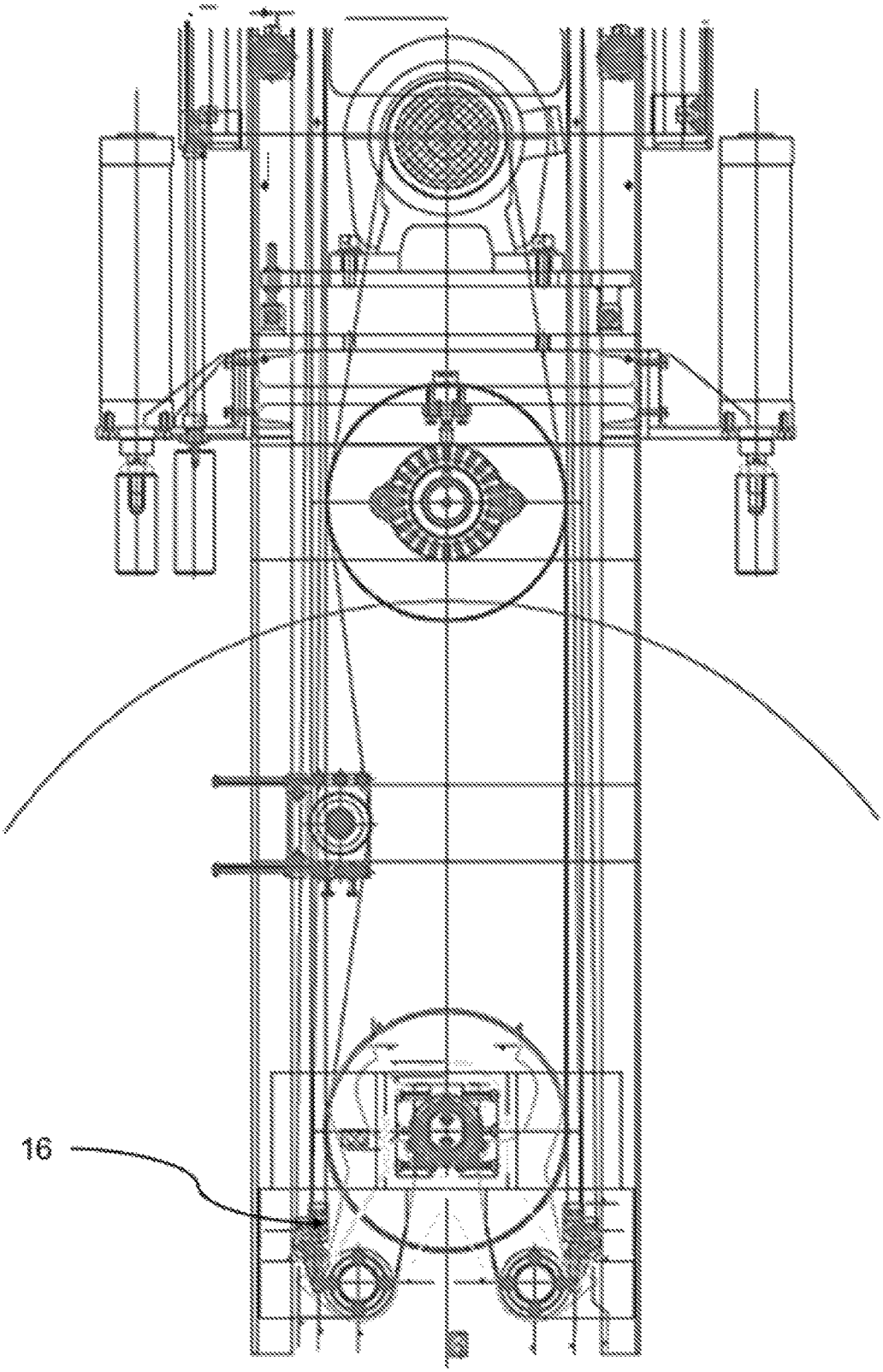
FIG. 3 shows a gripper of the gantry, in accordance with the present invention.
Figure 4:
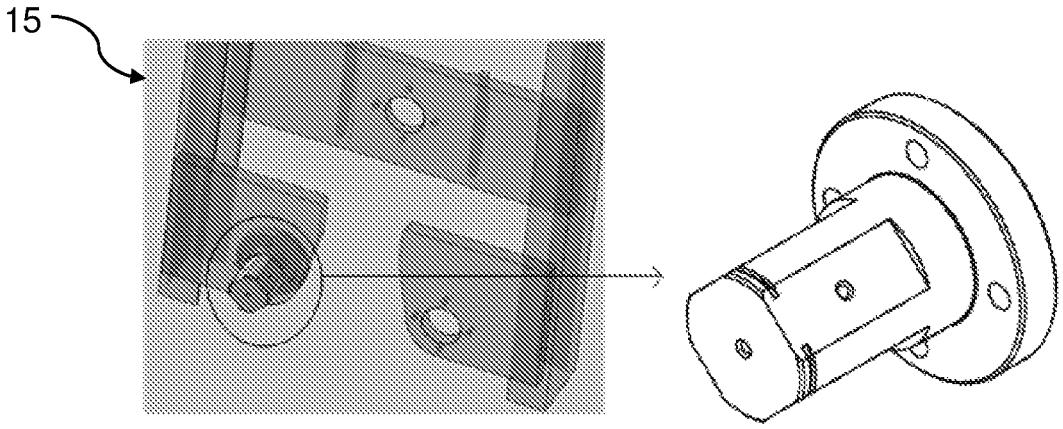
FIG. 4 shows gripper's pin, in accordance with the present invention.
Figure 5:
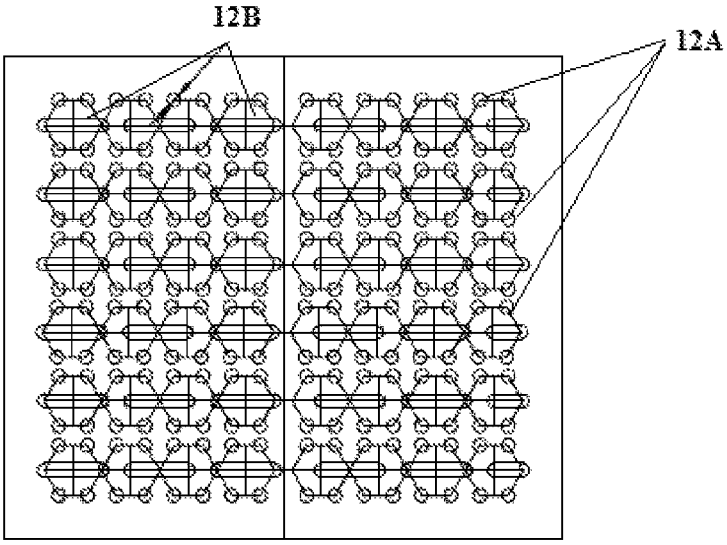
FIG. 5 shows a plurality of perforations and a plurality of slots, in accordance with the present invention.

Referring to FIGS. 1 to 5, a system (100) for impregnation of castings in accordance with the present invention is shown. The system (100) comprises a basket (10) and a gantry (50).

The basket (10) is rested on a basket rest platform inside the tank. The basket (10) is adapted for being loaded with multiple castings and removably placed in a vacuum chamber (A) for impregnation of the castings with a sealant/impregnation material (herein after 'the sealant') for sealing the porosity in the castings. In an embodiment, the basket (10) is made up of a material selected from any of a stainless steel (for example SS304), mild steel or any other steel material duly chrome plated or surface protected to avoid rusting. Further, the basket (10) is surface finished or polished in mirror finish polish to prevent the sealant from retaining thereon thereby preventing excess consumption of the sealant. The basket (10) includes a plurality of bins (12) and a stub (14).

The plurality of bins (12) is fitted in the basket (10) to hold multiple castings. The castings are of different sizes and shapes thereon. In an embodiment, the plurality of bins (12) are trays used for holding the casting and thus makes it possible to use the basket (10) in semi full condition with empty bins accounting for the vacant space. However, it is understood that the system (100) can use other types of bins known in the art depending on the castings as per various alternate embodiments thereof.

Each bin of the plurality of bins (12) includes a sliding mechanism/sliding fit arrangement (not shown) configured on an upper side (not numbered) thereof. The sliding mechanism allows any number of bins to be fitted within the basket (10). Specifically, the plurality of bins (12) is slidably fitted inside the basket (10) through the sliding mechanism. The sliding mechanism also restricts the castings from movement to ensure no banging of the plurality of bins (12) within themselves without causing the castings to come in contact with each other during rotation of the basket (10) during impregnation of castings. Specifically, the rotation of the basket (10) is carried out in tanks such as during drain, dunk wash, rotary wash, hot cure, blower and cooler tanks.

Further, the plurality of bins (12) is lined with a partition sheet (not shown). In an embodiment, the partition sheet is a made up of high temperature resistant soft material such as Polypropylene (PP) sheets, Polyurethane (PU) and the like. This makes the castings isolated from one another so that the castings do not get dented or damaged by banging. Also, the polypropylene sheets on the bottom of the plurality of bins (12) are fixed on the metal contact faces to save space and also for protection of the castings from the metal frame of the bin. The partition sheet such as polypropylene sheet includes a plurality of perforations (12A) and a plurality of slots (12B) configured thereon (refer FIG. 5). The plurality of perforations (12A) is adapted to provide water jet washing effect during wash and hot cure cycles of the casting. Further, the plurality of slots (12B) is carried out for intricate areas of the castings to provide complete access to the water for all holes in the castings for better washablity. In an alternate embodiment, the castings may also be restricted from motion in the plurality of bins (12) or the basket (10) by fixturing using stainless steel rods. The fixtures as compared to polypropylene separators results in lower retention and wastage of the sealant.

The stub (14) is configured on both ends (not numbered) of the basket (10) for poka yoke in orientation thereof during placement in infeed and outfeed positions of the gantry (50). The stub (14) makes the basket (10) suitable for lift and gripping by the gantry (50). In an embodiment, the stub (14) includes a hard chrome plating finish of 100 microns.

The basket (10) is capable of being removably/suitably placed in the vacuum chamber (A) such as an autoclave to allow impregnation of castings loaded thereon with the sealant. The sealant is supplied in the vacuum chamber (A) from a storage chamber (not shown). The vacuum chamber (A) is connected to the storage chamber with a valve (not shown) there between to start or stop the sealant flow. Specifically, the operation of the valve and the resulting flow of sealant are controlled by a plurality of sensors (not shown) configured in both the vacuum chamber (A) and the storage chamber such that the gantry (50) shall never make contact with the sealant in the vacuum chamber (A).

The valve is operated to start the flow of sealant from the storage chamber to the vacuum chamber to reach a predefined level therein during the impregnation of the castings. Once, the sealant is introduced into the porosity within the wall thickness of the castings through vacuum followed by pressure, the valve is operated to allow return of the remaining sealant from the vacuum chamber (A) back into the storage chamber so that the basket (10) with the impregnated castings is lifted out of the vacuum chamber (A) and placed in subsequent chambers such as in a rotary drain chamber (B), dunk wash chamber (C), rotational wash chamber (D), hotcure chamber (E) (refer FIG. 2) by the gantry (50) for curing the sealant liquid inside the castings by heating at elevated temperatures.

The gantry (50) is capable of lifting the basket (10) for placement thereof into the vacuum chamber (A) before the impregnation of the castings as well as removal thereof from the vacuum chamber (A) after the return of the sealant to the storage chamber to place the loaded basket (10) in the subsequent chambers after the impregnation of the castings. Specifically, the gantry (50) includes grippers (16) (refer FIG. 3) configured both sides (not numbered) thereof for gripping and lifting the basket (10) through the stubs (14). The grippers (16) are fail safe, maintenance free from constant jamming etc and designed for load bearing. In an embodiment, the grippers (16) are mild steel or stainless steel plated with a hard chrome plating finish of 100 microns.

The grippers (16) include pins (15) (refer FIG. 4) configured thereon. Unlike the conventional round pins, the gripper pins (15) of the present invention are designed in such a way to prevent sticking of sealant therein as well as in housing thereby preventing frequent jamming issue. Specifically, the pins (15) are machined on the diameter on even four sides with interconnected holes to provide ample point contact area for withstanding the weight of the basket (10) as well as to enable the easy flow of the wash water outside, thus eliminating the jamming of the grippers (16).

ADVANTAGES OF THE INVENTION

1. The use of plurality of bins (12) in the basket (10) prevents improper loading of the castings in the basket (10) by the operator.
2. The use of plurality of bins (12) within the basket (10) provides insulation to the casting from one another so that the castings do not get dented or damaged by banging.
3. The polypropylene sheets on the bottom of the plurality of bins (12) protect the castings from the frame of the basket (10) and the plurality of bins (12).
4. The sliding fit arrangement of the plurality of bins (12) restricts the castings from movement as well as ensures no banging of the plurality of bins (12) themselves during the rotation cycles.
5. The basket (10) is made of SS304 to avoid rusting.
6. The basket (10) includes the stubs (14) on both ends for gripping by the gantry (50) for orientation of the basket (10) during placement thereof in infeed and outfeed positions of the gantry (50).
7. The plurality of perforations (12A) provides water jet washing effect during wash and cure cycles of the castings.
8. The sliding fit arrangement of the plurality of bins (12) has been designed with ergonomics to avoid lifting effort by the operator when used in conjunction with a stack to pack and load the basket (10).
9. The use of plurality of bins (12) for holding the castings makes it possible to use the basket (10) in semi full condition with empty bins accounting for the vacant space.
10. The plurality of bins (12) enables the transportation of the castings from the production shop floor to the impregnation area thereby eliminating loading and unloading of the castings to and from the plurality of bins (12) during transportation.

The foregoing objects of the invention are accomplished and the problems and shortcomings associated with prior art techniques and approaches are overcome by the present invention described in the present embodiment. Detailed descriptions of the preferred embodiment are provided herein; however, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or matter. The embodiments of the invention as described above, and the methods disclosed herein, will suggest further modification and alterations to those skilled in the art. Such further modifications and alterations may be made without departing from the spirit and scope of the invention.

We claim:

1. A system for impregnation and washing of castings, comprising:

a vacuum chamber for impregnation of castings with a sealant;

at least one wash chamber for washing the castings after impregnation of the castings with the sealant;

a storage chamber for storing the sealant;

a valve connected to and in fluid communication with the vacuum chamber and the storage chamber, wherein the valve controls flow of the sealant to and from the storage chamber into and out of the vacuum chamber;

a basket comprising (i) a plurality of bins to hold the castings without causing the castings to come in contact with each other during impregnation of the castings with the sealant, (ii) a partition sheet lining each of the plurality of bins, the partition sheet being configured with a plurality of perforations and a plurality of slots that facilitate the washing of the castings, and (iii) stubs configured on each of first and second ends of the basket for orientation thereof;

a gantry configured to place the basket into the vacuum chamber before the impregnation of the castings, to remove the basket from the vacuum chamber after impregnation of the castings and a return of the sealant to the storage chamber, and to place the basket into the at least one wash chamber after the impregnation of the castings; and at least one gripper disposed on the gantry for gripping and lifting the basket through the stubs, wherein the at least one gripper comprises pins configured to prevent sticking of the sealant therein, thereby preventing jamming of the system.

2. The system as claimed in claim 1, wherein the basket is made at least one of stainless steel, mild steel, and a steel material duly chrome plated or surface protected to prevent rusting.

3. The system as claimed in claim 1, wherein the basket is one of surface finished or polished to prevent the sealant from being retained thereon, thereby preventing excess consumption of the sealant.

4. The system as claimed in claim 1, wherein the basket is configured to hold thereon multiple ones of the castings having varied sizes and shapes.

5. The system as claimed in claim 1, wherein each bin of the plurality of bins includes a sliding mechanism configured on an upper side thereof.

6. The system as claimed in claim 5, wherein the plurality of bins is slidably fitted inside the basket through the sliding mechanism.

7. The system as claimed in claim 1, wherein the stubs include a hard chrome plating finish of 100 microns.

8. The system as claimed in claim 1, wherein the at least one gripper comprises at least one of mild steel or stainless steel plated with a hard chrome plating finish of 100 microns.

9. The system as claimed in claim 1, further comprising:

a plurality of sensors disposed in both the vacuum chamber and the storage chamber, wherein the plurality of sensors control operation of the valve and the flow of sealant such that the gantry avoids contacting the sealant in the vacuum chamber.

* * * * *